United States Patent [19]

Jansen

[11] 4,210,294

[45] Jul. 1, 1980

[54] STRIP REEL

[75] Inventor: Johannes Jansen, Hilchenbach-Allenbach, Fed. Rep. of Germany

[73] Assignee: Schloemann-Siemag Akt., Düsseldorf, Fed. Rep. of Germany

[21] Appl. No.: 24,160

[22] Filed: Mar. 26, 1979

[30] Foreign Application Priority Data

Apr. 25, 1978 [DE] Fed. Rep. of Germany ..... 2818042

[51] Int. Cl.[2] ..... B65H 75/18; B21C 47/02

[52] U.S. Cl. ..... 242/72.1; 242/78.1

[58] Field of Search ..... 242/72.1, 72, 68.2, 242/78.1; 279/2

[56] References Cited

U.S. PATENT DOCUMENTS

| | | | |
|---|---|---|---|
| 2,556,149 | 6/1951 | Talbot | 242/72.1 X |
| 2,587,885 | 3/1952 | Paxson | 242/72.1 |
| 3,300,157 | 1/1957 | Koreishi | 242/78.1 |
| 3,537,665 | 11/1970 | Shumaker | 242/78.1 |

*Primary Examiner*—Edward J. McCarthy

*Attorney, Agent, or Firm*—Norman S. Blodgett; Gerry A. Blodgett

[57] ABSTRACT

A strip reel having a hollow shaft and having an expandable drum which is mounted on a free end of an axially-movable shaft for axial movement with the shaft and for axial movement relative to the shaft; the drum is moved axially relative to the shaft and the shaft is moved axially a corresponding equal amount in the opposite direction.

6 Claims, 4 Drawing Figures

STRIP REEL

BACKGROUND OF THE INVENTION

This invention relates to a method for operating a strip reel whose drum consists of several expandable segments which are braced by wedge-shaped contact surfaces that are movable in the axial direction against a central hollow shaft pivoted in the reel housing, and which are adjusted by means of a ram that is mounted in the hollow shaft.

The invention relates further to a strip reel for carrying out the method, the reel being equipped with a shifting drive for the reel housing, which brings about the pushing in and out of the reel drum relative to the strip coil and/or relative to the strip centering control mechanism.

German patent publications DE-AS 10 07 279 and DE-PS 17 52 185 show strip reels that have a drum consisting of several expandable segments that engage wedge-shaped surfaces movable in the axial direction against a central hollow shaft that is pivoted in a reel housing. The segments can be adjusted relative to the hollow shaft by means of a ram that is mounted in the hollow shaft.

Such strip reels have advantageous over the type shown, for example, in German patent publication DL-PS 34 240 insofar as the direct bracing of the drum segments against the circumference of the hollow shafts results in comparatively small structural dimensions which produce a substantial reduction of the rotation moment. This also reduces the moments of acceleration, braking, and allows instantaneous stops. Also, the bearing diameters for the reel shaft can be considerably reduced, so that, even with increased normal speeds, the wear on the bearings will be less.

The strip reels shown in German patent publications DE-AS 10 07 279 and DE-PS 17 52 185 suffer, however, from the deficiency that, when the drum segments are spread, there occurs simultaneously an axial shifting of the segments relative to the reel shaft. This axial shifting may impair the orderly uncoiling of the strip into the subsequent processing plants, unless, subsequent to the clamping of the strip coil onto the reel drum, an appropriate correction of the position of the whole reel is carried out relative to the subsequent processing plant. Such a positional correction of the entire strip reel can be carried out by means of the shifting drive which pushes the reel drum in and out relative to the strip coil and/or is used for the center control of the strip coil. However, carrying out such a subsequent positional correction is comparatively time consuming and also requires an operating crew with considerable skill.

It is, therefore, a principal object of the present invention to provide an improved reel which eliminates the deficiencies of the known strip reels described above.

Another object of the invention is a method for the operation of the improved strip reel, which would allow a satisfactory unwinding of the strip from the coil after it has been clamped.

A further object of the present invention is the provision of a coil reel and method of operating the coil reel in which relative shifting between the segments and the hollow shaft is picked up and converted into an opposing shifting movement of the reel housing on the reel bed of a corresponding magnitude.

It is another object of the instant invention to provide a coil reel in which the drum segments, during their movement for the purpose of clamping the strip, always retain their given position relative to the entry center line of the subsequent processing stations downstream of the reel, thus assuring in this way that the strip reel can be readily placed in service after the clamping process has been concluded.

A still further object of the invention is the provision of apparatus and a method for operating an improved coil reel, which includes measuring the relative shifting of the ram relative to the hollow shaft and using this measurement as a control value for the shifting drive of the reel housing; since the relative shifting of the ram relative to the hollow shaft corresponds to the relative shifting between segments of the reel drum and the hollow shaft that carries and guides them, it is possible to ascertain in this way the respective specific correction value in the most simple manner and with the lowest possible relative error.

With these and other objects in view, as will be apparent to those skilled in the art, the invention resides in the combination of parts set forth in the specification and covered by the claims appended hereto.

SUMMARY OF THE INVENTION

In general, the invention consists of a method operating a strip reel having a hollow shaft and an expandable drum mounted on a free end of an axially movable shaft for axial movement with the shaft and for axial movement relative to the shaft. The method comprises moving the drum axially relative to the shaft and moving the shaft axially a corresponding equal amount in the opposite direction.

The invention also consists of apparatus for carrying out the above method and comprising a strip reel which is equipped with a shifting drive for the reel housing for effecting the pushing in and out of the reel drum relative to the strip coil and/or the strip center control. A measuring device is arranged between the segments and the hollow shaft, which is in communication with a control element for the shafting drive.

Another feature of the invention provides that the measuring device is in adjusting communication with the rear end of the ram that moves the segments and that the control element assigned to the shifting device can be set and adjusted in accordance with the distance. This control element can actually be of a design similar to the measuring device assigned to the segments or to the ram, whereby the measuring device and the control element work together in an opposite sense and form through this the respective specific correction value for the shifting drive.

Finally, another feature is that the drive for expanding the drum segments and the shifting drive consist in each case of a double-acting hydraulic cylinder and that the supply of the pressure liquid to the shifting drive can be regulated through a control valve that is controllable by means of the measuring device.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
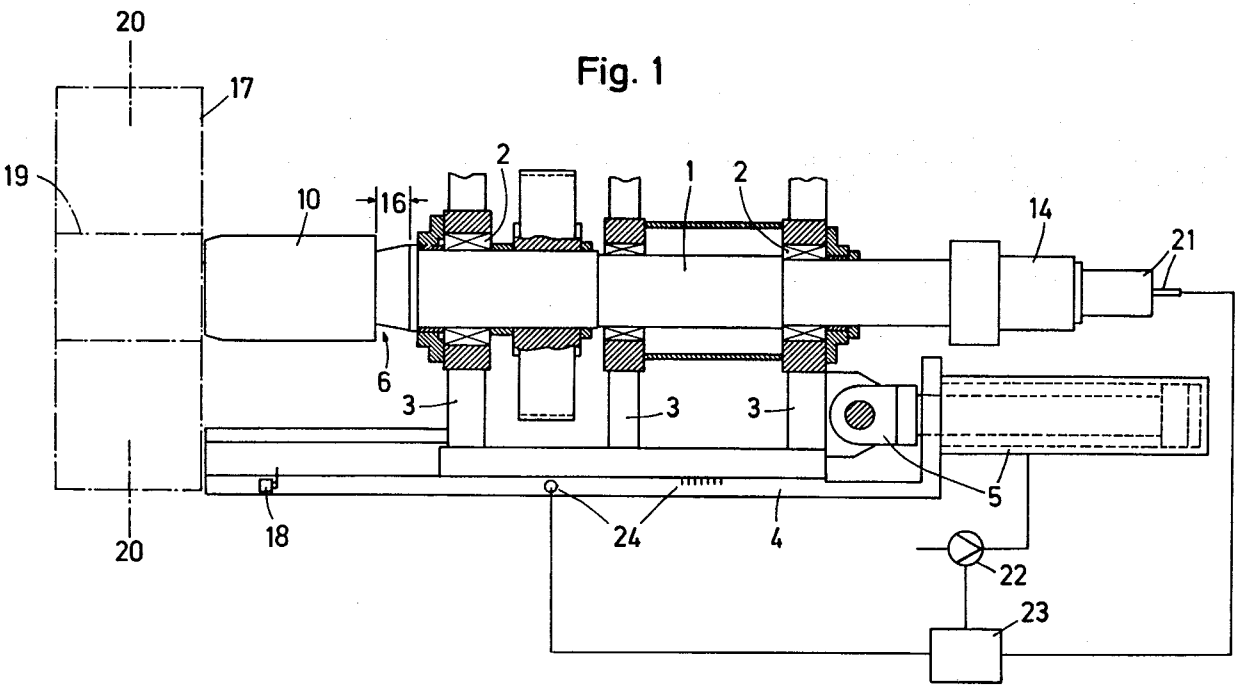
FIG. 1 is a diagrammatic side elevational view of a strip reel of the present invention showing the drum before it enters the strip coil.

The drawings show a strip reel having a hollow shaft 1 that is axially immovable, but is supported for rotation in roller bearings 2 of a reel housing 3.

The reel housing is guided for movement in the direction of the longitudinal axis of the hollow shaft 1 on a stationary reel bed 4 and can be moved along this axis by means of a shifting drive 5, shown in the drawings as a hydraulic cylinder. At its forward overhung end, the hollow shaft 1 is provided with wedge-shaped contact surface 7 on which four segments 8 are held and guided by means of similarly wedge-shaped supporting surfaces 9. The segments 8 jointly form the actual reel drum 10 which, as needed, can be radially spread or contracted. The segments 8 are held with their wedge-shaped supporting surfaces 9 on the wedge-shaped contact surfaces 7 of the hollow shaft 1 and are simultaneously axially shiftable relative to the hollow shaft 1.

The axial movement of the segments 8 relative to the hollow shaft 1 is achieved by means of a ram 12 that is centrally guided through the hollow shaft 1. The ram 12 is operatively connected to the segments 8 at the front end of the hollow shaft 1 by a driving flange 13. Ram 12 is shifted in the axial direction by means of a hydraulic cylinder 14 arranged at the rear end of the hollow shaft 1. As can be seen in the lower half in FIG. 4, the reel drum 10 is radially pulled together or contracted when the ram 12 is pushed through the hydraulic cylinder 14 to the left. To spread the drum 10, the ram 12 is pulled through the hydraulic cylinder 14 to the right, as can be seen in the upper half in FIG. 4.

Figure 4:
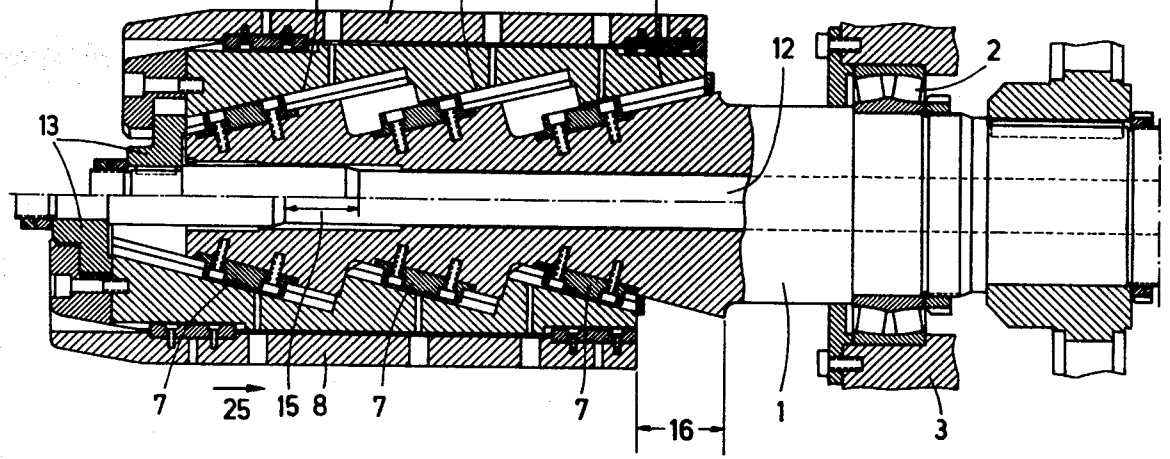
FIG. 4 is a partial vertical sectional view taken through the reel axis, on an enlarged scale, showing the construction of the reel drum, the lower half with contracted segments and in the upper half with expanded segments.

The radial expanding and contracting of the reel drum 10 requires an axial movement of the ram 12 whose maximum is the distance 15 in FIG. 4 relative to the hollow shaft 1 or, respectively, a corresponding axial shifting of the individual segments 8 by the distance 16 relative to the hollow shaft 1.

Figure 2:
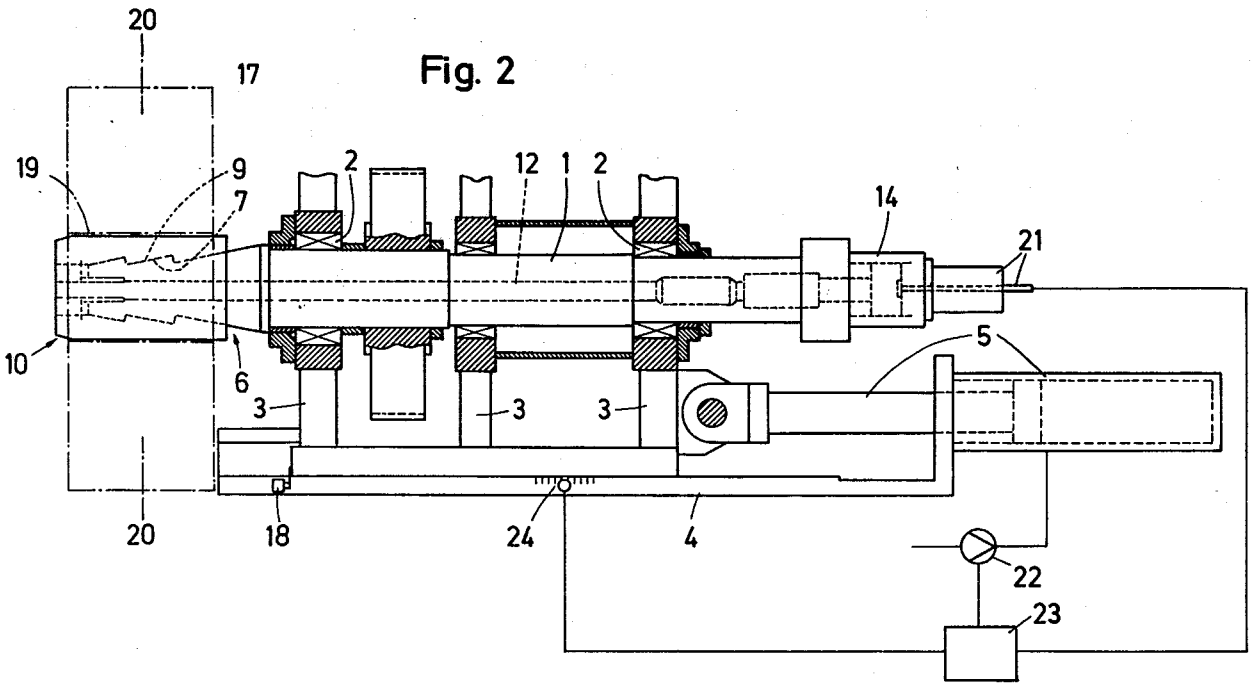
FIG. 2 is a view similar to FIG. 1, showing the reel drum after it has axially entered the opening in the strip coil, but while still contracted.
Figure 3:
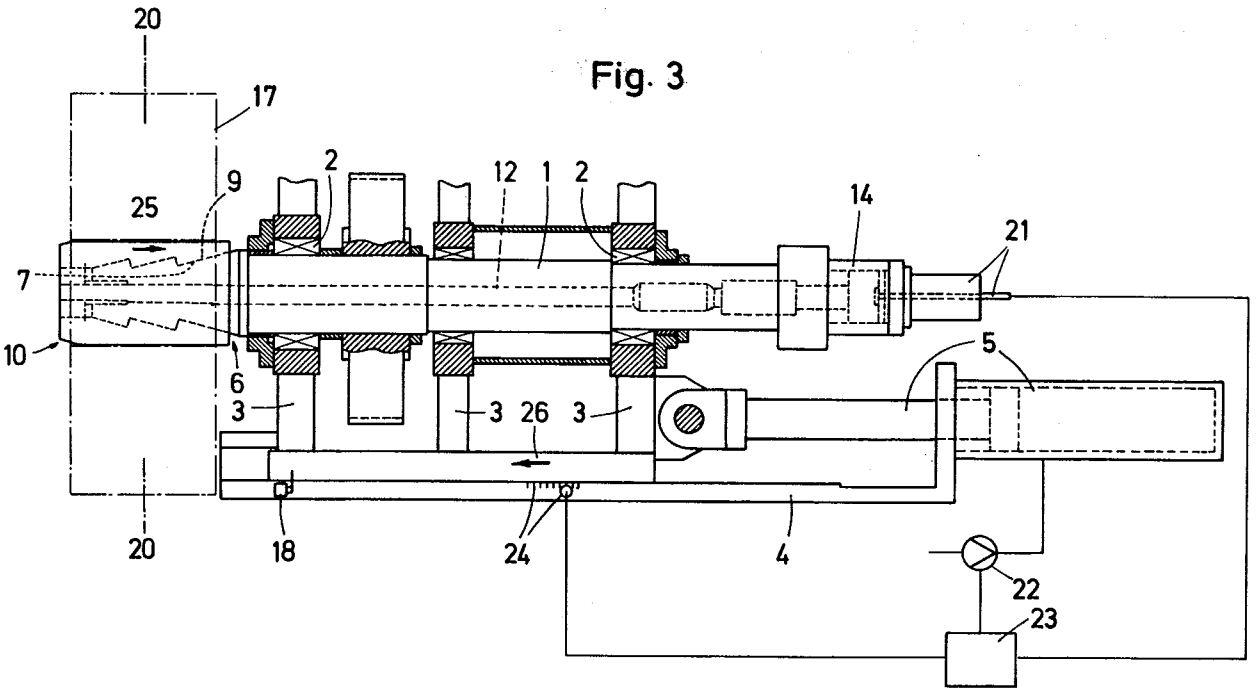
FIG. 3 is a view similar to FIG. 2, showing the drum after it has been radially expanded for clamping the strip coil.

For the purpose of mounting the strip roll 17 on the reel drum 10, it is necessary first to shift the whole strip reel, including the radially-contracted reel drum 10, on the stationary reel bed 4 from the position shown in FIG. 1 to the position shown in FIG. 2. This movement is effected by means of the shifting drive 5 and is terminated by a limit switch 18 that interrupts the supply of the hydraulic fluid to the hydraulic cylinder 5. The limit switch 18 determines the normal position of the strip reel which assures the orderly unwinding of the strip into the subsequent processing apparatus. This normal position of the strip reel can, as required, be automatically corrected during the unwinding operation by means of a so-called strip centering control and through a corresponding control of the shifting drive 5. However, before the strip reel can be placed in service for unwinding the strip, it is necessary to first expand the reel drum 10 inside the central opening 19 of the strip coil 17. Since this expanding motion is related to an axial shifting of the drum segments 8 relaive to the hollow shaft 1 or the reel housing 3, it is essential that any resulting axial shift of the strip 17 from its unwinding median plane 20—20 can be eliminated. To achieve this, a measuring device 21 is positioned between the hollow shaft 1 and the ram 12 that is movable in it. The measuring device 21 accurately ascertains the specific relative shift between the shaft 1 and ram 12. It converts it into a control value that influences the shifting drive 5 of the reel housing 3 in such a way that the reel housing 3 is automatically shifted by an amount equal to the corresponding dimension on the stationary reel bed 4 and in a direction opposite to the axial adjustment of the drum segments 8.

The control element for the control valve 22 which effects the supply of hydraulic fluid to the shifting drive consists of a control value emitter 23 to which are constantly fed, on the one hand, the measured values ascertained by the measuring device 21 and on the other hand, by a distance-measuring device 24 located between the reel bed 4 and the reel housing 3. The measuring device 21 and the distance-measuring device 24 cooperate with the control value emitter 23 in such a way that the latter keeps the control valve 22 open as long as there exists a difference between the measured values ascertained by the measuring device 21 and by the distance measuring device 24. When the difference between the two measured values that are determined by the measuring device 21 and the distance measuring device 24 has become zero, the control value emitter 23 shuts the control valve 22 and places the shifting drive 5 in inoperative condition.

Since the measuring device 21 and the distance measuring device 24 operate in a contrary sense, the shifting drive 5 is automatically controlled in the direction of arrow 26, so that it moves in the direction opposite to the shifting direction 25 of the reel drum 10 and thereby keeps the strip coil 17 always exactly on the unwinding median plane 20—20. Since the distance-measuring device 24 located between the reel bed 4 and the reel housing 3 only becomes operative after the strip has moved from the position of FIG. 1 to the position of FIG. 2, it is possible at the same time to use the limit switch 18, which in this case shuts down the shifting drive 5 to make the distance-measuring device 24 effective.

It is readily feasible to let both the measuring device 21 as well as the distance-measuring device 24 operate in a capacitive or inductive manner and to design the associated control value emitter 23 as a measuring bridge which either opens or closes the control valve 22, depending on its specific state. In the above-described manner, it becomes possible with very little additional expenditure to provide a strip reel drum 10 is fully automatically and accurately aligned to the given unwinding median plane 20—20 even through the reel drum segments 8 are subjected to an axial shift for the purpose of expanding or contracting relative to the hollow shaft 1 that carries them.

In conclusion, it should be pointed out that the method of operation described above and the control arrangement provided for carrying it out can be used not only on strip reels with an overhung reel drum; they can be applied as well to so-called "double" reels where two reel drums 10 enter the opposite sides of the same strip coil.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Method of operating a strip reel having a hollow shaft with a central longitudinal axis and a free end, a reel housing for rotatably supporting the hollow shaft and mounted on the stationary reel bed for movement along said axis, and an expandable drum mounted on the free end of the shaft for axial movement with the shaft and axial movement relative to the shaft, said drum having a plurality of segments which move in a transverse direction to said axis upon movement of the said axis relative to the shaft, said method comprising the steps of:

(a) moving the housing along said axis in a first-direction until the drum occupies a reel unwinding position, (b) moving the drum along said axis relative to the shaft in a second direction opposite to the first direction and causing the segments to move in said transverse direction, (c) measuring the amount of movement of the drum in said second direction, and (d) moving the housing along said axis in said first direction an amount equal to said measured amount.

2. A strip reel comprising:

(a) a stationary reel bed, (b) a hollow shaft having a central longitudinal axis and a free end, (c) a reel housing for rotatably supporting the hollow shaft and mounted on the stationary reel bed for movement along said axis, (d) an expandable drum mounted on the free end of the shaft both for axial movement with the shaft and for axial movement relative to the shaft, said drum having a plurality of segments which move in a transverse direction to said axis upon movement of the drum along such axis, (e) means for moving the drum along said axis relative to the shaft, said means including a ram axially slidable within the hollow shaft and operatively connected to the drum, and (f) shifting means for automatically moving the reel housing along said axis a distance equal and opposite to the axial movement of the drum, the shifting means including drives means for moving the housing along said axis, means for measuring the axial movement of the drum relative to the hollow shaft and producing a signal that is proportional to the amount of said axis movement, and control means for actuating the drive means in accordance with said signal.

3. A strip reel as recited in Claim 2, wherein the drive means comprises a hydraulic cylinder, while the control means includes a control valve operatively connected to the hydraulic cylinder and a control unit for receiving said signals, which unit is operatively connected to the control valve.

4. A strip reel comprising:

(a) a stationary reel bed, (b) a hollow shaft having a central longitudinal axis and a free end, (c) a reel housing for rotatably supporting the hollow shaft and mounted on the stationary reel bed for movement along said axis, (d) an expandable drum mounted on the free end of the shaft both for axial movement with the shaft and for axial movement relative to the shaft, said drum having a plurality of segments which move in a transverse direction to said axis upon movement of the drum along such axis, (e) means for moving the drum along said axis relative to the shaft, said means including a ram axially slidable within the hollow shaft and operatively connected to the drum, (f) shifting means for automatically moving the reel housing along said axis a distance equal and opposite to the axial movement of the drum, the shifting means including a shifting drive for the reel housing that brings about tha axial movement of the reel drum relative to the hollow shaft, and (g) a measuring device located between the segments and the hollow shaft, the measuring device being in communication with a control element for the shifting device.

5. A strip reel as recited in claim 4, wherein the measuring device is in adjusting communication with the rear end of the ram that moves the segments, and wherein the control element assigned to the shifting device can be set and adjusted.

6. A strip reel as recited in claim 4, characterized by the fact that an expanding drive for the drum segments and the shifting device consists in each of a double-acting hydraulic cylinder, and wherein the pressure fluid supply to the shifting drive is regulated by means of a control valve that is regulated by the measuring device.

* * * * *